United States Patent [19]

Murao

[11] 4,276,086

[45] Jun. 30, 1981

[54] GOLD ALLOY WITH COPPER, SILVER AND ZINC

[75] Inventor: Masami Murao, Tokyo, Japan

[73] Assignee: Kabushiki Kaisha Murao Shoten, Tokyo, Japan

[21] Appl. No.: 109,875

[22] Filed: Jan. 7, 1980

[30] Foreign Application Priority Data

Jan. 18, 1979 [JP] Japan ..... 54-4567
Mar. 19, 1979 [JP] Japan ..... 54-31055

[51] Int. Cl.[3] ..... C22C 30/00

[52] U.S. Cl. ..... 75/134 C; 75/134 B; 75/165

[58] Field of Search ..... 75/134 B, 134 C, 165

[56] References Cited

U.S. PATENT DOCUMENTS

| | | | |
|---|---|---|---|
| 2,042,155 | 5/1936 | Leach | 75/165 |
| 2,200,050 | 5/1940 | Auswärter | 75/165 |
| 2,216,495 | 10/1940 | Loebich | 75/165 |
| 2,229,463 | 1/1941 | Leach | 75/165 |
| 2,270,594 | 1/1942 | Leuser | 75/134 |
| 2,274,863 | 3/1942 | Leuser | 75/165 |
| 2,596,454 | 5/1952 | Williams | 75/165 |
| 4,012,228 | 3/1977 | Dudek et al. | 75/134 C |

*Primary Examiner*—L. Dewayne Rutledge
*Assistant Examiner*—Upendra Roy
*Attorney, Agent, or Firm*—Lackenbach, Lilling & Siegel

[57] ABSTRACT

A gold alloy classified into 8 to 12 carats contains 30.0 to 50.0% by weight of gold and the remainder is an alloying composition which includes 75.2–77.1% of copper, 13.6 to 16.2% of silver and 6.7 to 11.2% of zinc. The preferred alloys are 9 and 10 carats. The alloys exhibit satisfactory color tone and luster and have improved physical and chemical properties including workability, hardness, chemical resistance and perspiration resistance. The alloys are fabricated into articles which are surface finished by buffing or electrolytic polishing.

6 Claims, 1 Drawing Figure

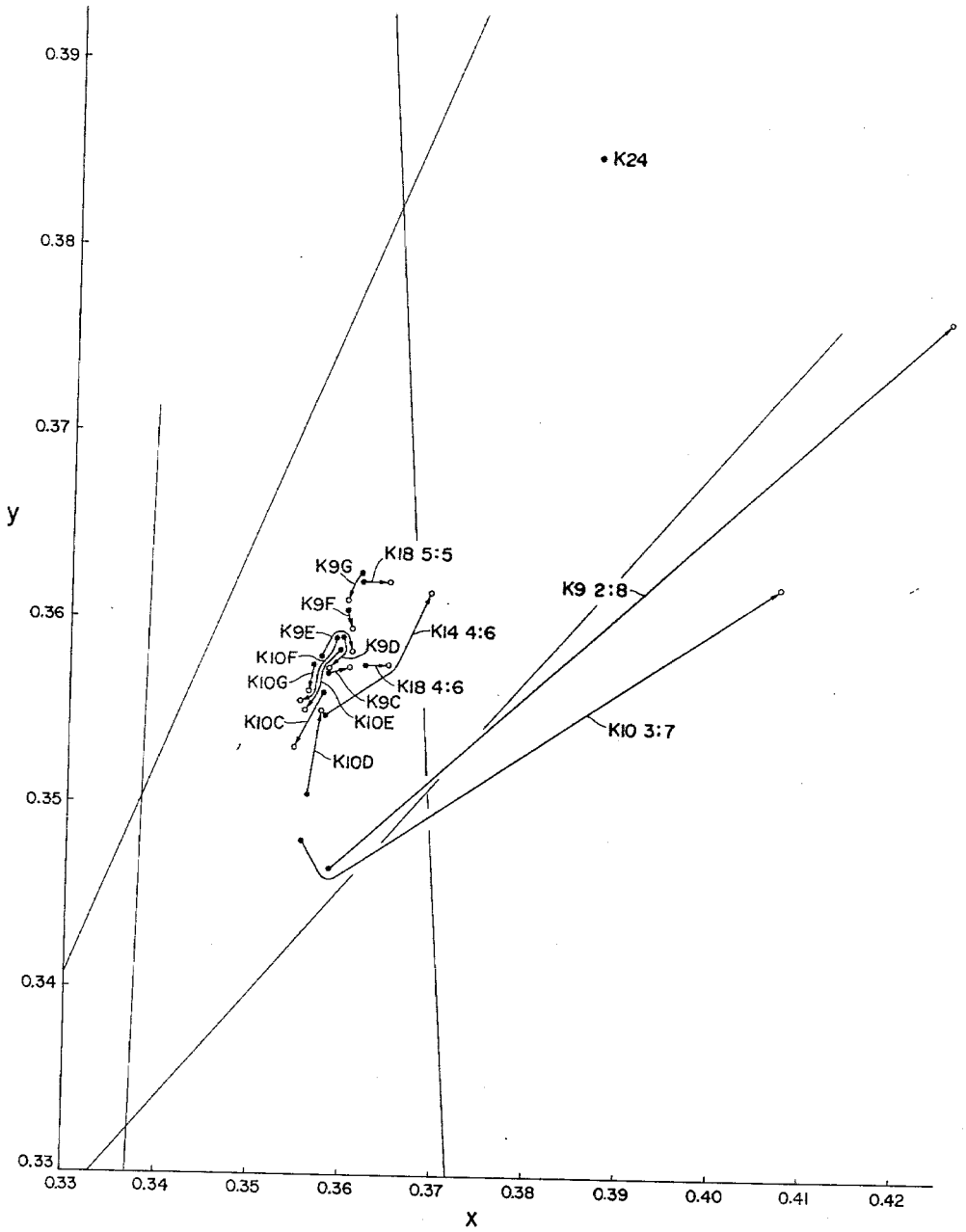
0.39
0.38
0.37
0.36
0.35
0.34
0.33
y
0.33
0.34
0.35
0.36
0.37
0.38
0.39
0.40
0.41
0.42
x
• K24
K9 2:8
K10 3:7
K18 5:5
K14 4:6
K18 4:6
K9G
K9F
K9E
K9D
K9C
K10F
K10G
K10C
K10E
K10D

GOLD ALLOY WITH COPPER, SILVER AND ZINC

BACKGROUND OF THE INVENTION

This invention relates to quaternary gold alloys, and more particularly, to gold-silver-copper-zinc alloys generally designated as 8 to 12-carat gold alloys.

Gold is a valuable metal and is used ornamentally in the form of necklaces, pendants, rings or the like. For ornament use, pure gold or so-called 24-carat gold can be easily worked, but is susceptible to damage because it is relatively soft. For this reason, 14 to 18-carat gold alloys are generally used for ornaments.

As is publicly known, 18-carat gold alloys are those containing 18 parts by weight of pure gold per 24 parts by weight of the entire alloy. That is, the 18-carat gold alloys contain 75% by weight of pure gold. The 14-carat gold alloys contain 58.3% by weight of pure gold. The remainder, for example 25% in the case of 18 carats, consists of alloying components which are usually silver and copper. More particularly, silver and copper are incorporated at a relative weight ratio of 6:4 to 5:5 into gold alloys. Such gold alloys must have not only golden color tone and luster, but also improved hardness and abrasion resistance.

In the gold ornament industry, 14-carat gold is believed to be the minimum level to work into a workpiece having satisfactory golden color tone and luster.

Prior art gold alloys of 9 to 10 carats are less attractive in color tone. Those alloys containing copper and silver in a weight ratio of 8:2 are reddish gold and those containing copper and silver in a ratio of 7:3 are slightly reddish gold although they are easy to work. Since they are susceptible to oxidation, they turn more reddish as time goes by. In general, articles of 9 to 10 carats are futher plated with 18 carat or more gold alloys or pure gold to compensate for the lack of color tone and oxidation resistance.

SUMMARY OF THE INVENTION

It is an object of the present invention to provide a gold alloy which is classified into 8 to 12 carats, particularly, 9 to 10 carats, and has improved color tone as well as sufficient physical and chemical properties.

Another object of the present invention is to provide a 9 to 10-carat gold alloy which is not susceptible to oxidation or discoloration in the absence of a plated overcoat and hence, can maintain a golden luster for an extended period of time.

According to this invention, there is provided a gold alloy which comprises 30.0 to 50.0% by weight of gold and 70.0 to 50.0% by weight of an alloying composition which includes 75.2 to 77.1% by weight of copper, 13.6 to 16.2% by weight of silver and 6.7 to 11.2% by weight of zinc. When the contents of the alloying elements are converted into percentages on the basis of the total weight of the alloy, the gold alloy of the present invention comprises, in percent by weight, 30.0 to 50.0% gold,
37.6 to 54.0% copper,
6.8 to 11.3% silver, and
3.3 to 7.8% zinc.

Preferably, the gold alloy of the present invention comprises 33.3 to 41.7% by weight of gold and the balance is the alloying composition defined above. More preferably, the gold alloy of the present invention contains 37.5 to 41.7% by weight of gold.

The preferred alloying composition includes
75.7 to 76.7% by weight of copper,
14.2 to 15.5% by weight of silver, and
7.8 to 10.1% by weight of zinc
on the basis of the total weight of the alloying composition.

The gold alloy of the present invention may be improved in corrosion resistance by further containing an effective amount, preferably 1–5% of an element selected from the group consisting of platinum, palladium, ruthenium and tin, and mixtures thereof.

BRIEF DESCRIPTION OF THE DRAWING

The single FIGURE is a chromaticity diagram of samples according to the present invention and the prior art before and after immersion in a corrosive solution.

DESCRIPTION OF THE PREFERRED EMBODIMENT

The following Example is illustrative of the present invention

EXAMPLE

A number 9- to 10-carat gold alloy samples were prepared by bending gold with varying compositions of silver, copper and zinc as shown in Table I.

TABLE I

| Sample | Alloying Composition (% by weight) Ag | Cu | Zn | Color tone | Workability | |
|---|---|---|---|---|---|---|
| A | 16.16 | 77.12 | 6.72 | X | ○ | |
| B | 15.84 | 76.88 | 7.28 | ○ | ○ | |
| C | 15.52 | 76.64 | 7.84 | ○ | ◎ | Suitable for buff finishing only |
| D | 15.2 | 76.4 | 8.4 | ○ | ◎ | |
| E | 14.88 | 76.16 | 8.96 | ◎ | ◎ | |
| F | 14.56 | 75.92 | 9.52 | ◎ | ◎ | Suitable for diamond-cut finishing and electrolytic polishing |
| G | 14.24 | 75.68 | 10.08 | ◎ | ○ | |
| H | 13.92 | 75.44 | 10.64 | ○ | ○ | |
| I | 13.60 | 75.20 | 11.20 | Δ | Δ | |

The contents of the alloying elements in the total weight of 9- and 10-carat gold alloys of 1000 g are shown in Tables II and III, respectively.

TABLE II

| Sample | 9 Carat Alloy (pure gold 375 grams) Ag(g) | Cu(g) | Zn(g) |
|---|---|---|---|
| K9 A | 101 | 482 | 42 |
| K9 B | 99 | 481 | 46 |
| K9 C | 97 | 479 | 49 |
| K9 D | 95 | 478 | 53 |
| K9 E | 93 | 476 | 56 |
| K9 F | 91 | 475 | 60 |
| K9 G | 89 | 473 | 63 |
| K9 H | 87 | 472 | 67 |
| K9 I | 85 | 470 | 70 |

TABLE III

| Sample | 10 Carat Alloy (pure gold 417 grams) Ag(g) | Cu(g) | Zn(g) |
|---|---|---|---|
| K10 A | 94 | 450 | 39 |
| K10 B | 92 | 448 | 42 |
| K10 C | 90 | 447 | 45 |
| K10 D | 89 | 445 | 49 |
| K10 E | 87 | 444 | 52 |
| K10 F | 85 | 443 | 53 |
| K10 G | 83 | 441 | 59 |

TABLE III-continued

| | 10 Carat Alloy (pure gold 417 grams) | | |
|---|---|---|---|
| Sample | Ag(g) | Cu(g) | Zn(g) |
| K10 H | 81 | 440 | 62 |
| K10 I | 79 | 438 | 65 |

The thus prepared quaternary gold alloy samples within the scope of the present invention had a Vicker's hardness of 110–280, and a melting point of 790°–1050° C. This hardness range indicates a wider range of working or application as compared with the conventional 18-carat gold alloys having a Vicker's hardness of 100–180. It was found that these samples are well suited for gold working. These samples showed improved oxidation resistance, and their color tone and luster appeared equivalent to 14 to 18 carat gold alloys.

Experiment 1: Gloss

A number of gold alloy samples were measured for 60°–60 ° mirror surface gloss according to JIS Z 8741 using a glossmeter (GM-3 manufactured by Murakami Shikisai Giken K. K.) with a 1/10 filter. The results are shown below.

TABLE IV

| | 60°–60° Gloss Value | |
|---|---|---|
| Sample | Upper surface | Lower surface |
| K24 | 74.4 | 1.6 |
| K18 4:6 | 77.8 | 5.8 |
| K18 5:5 | 80.4 | 5.5 |
| K14 4:6 | 80.2 | 7.3 |
| K10 3:7 | 79.3 | 8.1 |
| K9 2:8 | 76.5 | 7.4 |
| K10 C | 78.9 | 6.7 |
| K10 D | 77.9 | 7.1 |
| K10 E | 77.5 | 7.5 |
| K10 F | 76.8 | 6.9 |
| K10 G | 73.6 | 6.9 |
| K9 C | 80.5 | 7.9 |
| K9 D | 77.0 | 6.0 |
| K9 E | 78.9 | 6.0 |
| K9 F | 77.3 | 6.5 |
| K9 G | 73.9 | 7.1 |

In the above and the following Experiments, samples are referred to as "K18 4:6" or "K10 C", for example. "K18 4:6" designates the 18 carat gold containing silver and copper at a weight ratio of 4:6. "K10 C" designates the 10 carat gold containing alloying composition C shown in Table I and it also appears in Table III.

Experiment 2: Chemical Resistance

Samples were weighed and then immersed in aqueous solutions containing 10% nitric acid, 10% sodium chloride and 10% sodium hydroxide, respectively, at room temperature for 5 hours. The immersed samples were again weighed to determine weight loss. The measurement limit was 0.1 mg. All the samples within the present invention were found unchanged in weight.

Experiment 3: Perspiration Resistance

Samples were immersed in a test solution at room temperature for 24 hours. The test solution used is defined in JIS L 0848, Procedure $C_1$, "Test Method for Color Fastness to Perspiration", which contains 10 g of sodium chloride, 1 g of lactic acid and 2.5 g of disodium phosphate hydrate per liter of water. In this experiment, the test solution further contained 1 g of urea, 0.2 ml of aqueous ammonia and 0.2 g of sodium sulfide hydrate.

The samples before and after immersion were measured for chromaticity. The x- and y-coordinate chromaticity values were calculated from the spectral distribution, tristimulus value and relative spectral reflectance of a sample. The results are plotted in a chromaticity diagram of the Figure. Black and white circles correspond to the chromaticity values of a sample before and after immersion, respectively. A solid line connecting black and white circles is depicted only for showing the correspondence of black and white circles of the same sample. In the diagram, straight lines corresponding to saturations of 2 and 4 and hues of 5Y and 5YR at a brightness of 8 are also drawn.

As seen from the chromaticity diagram, the samples of the present invention as identified K10 C–G and K9 C–G are comparable to 14 or 18 carat gold samples in chromaticity. The samples of the present invention after subjected to the perspiration test show small changes in chromaticity, but are still in the acceptable range. On the contrary, the prior art samples as identified K9 2:8 and K10 3:7 are greatly discolored into orange and red.

Gold alloys having compositions falling within the range defined by the present invention may be worked into various types of ornaments. Worked articles as such are acceptable, but not satisfactory. Suitable surface treatments will impart a satisfactory finish to such articles. Surface treatments may be classified into two types of treatment depending on the shape of articles.

One surface treatment is buffing particularly suited for articles having a relatively flat surface. As is well known, a rotating buff is brought into contact with a workpiece at the surface with the aid of an abrasive grain, for example, chromium oxide.

Another surface treatment is the so-called electrolytic polishing particularly suited for articles having an irregular surface, such as chains. A workpiece is placed as an anode in an electrolytic bath and current is conducted at a high current density to carry out electrolysis, thereby dissolving away microscopic irregularities at the surface. The resulting workpiece is very smooth over the entire surface.

The electrolytic polishing uses an electrolytic solution which may be strong alkali (in the presence or absence of a cyanide) or strong acid. Since the workpiece which is removed out of the bath upon completion of electrolytic polishing has part of the highly erosive solution entrained at the surface, it is subject to barrel polishing in a rinse containing a detergent. The rinse may further contain an anti-oxidizing compound.

The barrel polishing is carried out by placing a workpiece in a rotary barrel containing a number of steel balls (diameter 2 mm). The barrel is rotated to bring the workpiece into contact with the balls and rinse, thereby polishing and washing the workpiece at the surface as well as hardening its surface.

By polishing the workpiece in the rinsing mixture of the detergent and the anti-oxidizing compound, the workpiece is polished and hardened at the surface. The resulting workpiece, despite being 8 to 12 carat, exhibits a luster equivalent to those of 14 to 18-carat gold alloys.

As described in the foregoing, gold alloys of the present invention are easy to work into an article and resistant against oxidation, and maintain golden luster and color tone equivalent to those of 14- or 18-carat gold. The present gold alloys may be worked easier than the conventional 18 carat gold and are very suitable to work into ornaments.

What is claimed is:

1. A gold alloy consisting of:
30.0 to 50.0% by weight of gold and
70.0 to 50.0% by weight of an alloying composition consisting of:
75.2 to 77.1% by weight of copper,
13.6 to 16.2% by weight of silver and
6.7 to 11.2% by weight of zinc.

2. A gold alloy according to claim 1 which contains 33.3 to 41.7% by weight of gold.

3. A gold alloy according to claim 2 which contains 37.5 to 41.7% by weight of gold.

4. A gold alloy according to any one of claims 1 to 3 wherein said alloying composition consisting of
75.7 to 76.7% by weight of copper,
14.2 to 15.5% by weight of silver and
7.8 to 10.1% weight of zinc.

5. An article fabricated from a gold alloy as defined in claim 1, said article being surface finished by buffing.

6. An article fabricated from a gold alloy as defined in claim 1, said article being surface finished by electrolytic polishing.

* * * * *